US007546077B2

(12) United States Patent
Hong et al.

(10) Patent No.: US 7,546,077 B2
(45) Date of Patent: Jun. 9, 2009

(54) ROTARY ROLLER STRUCTURE EMPLOYING INTERVAL MAINTENANCE MEMBERS AND FUSER OF IMAGE FORMING APPARATUS EMPLOYING THE SAME

(75) Inventors: Seock-deock Hong, Suwon-si (KR); Kyung-shig Chung, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 61 days.

(21) Appl. No.: 11/405,491

(22) Filed: Apr. 18, 2006

(65) Prior Publication Data

US 2006/0291920 A1 Dec. 28, 2006

(30) Foreign Application Priority Data

Jun. 28, 2005 (KR) ..... 10-2005-0056204

(51) Int. Cl.
*G03G 15/20* (2006.01)

(52) U.S. Cl. ..... 399/328

(58) Field of Classification Search ..... 399/313, 399/328

See application file for complete search history.

(56) References Cited

U.S. PATENT DOCUMENTS

| | | | | |
|---|---|---|---|---|
| 3,893,317 | A * | 7/1975 | Clarke | 72/10.4 |
| 4,212,631 | A * | 7/1980 | Franke et al. | 432/60 |
| 6,385,417 | B1 | 5/2002 | Tanaka et al. | 399/164 |
| 2002/0106224 | A1 | 8/2002 | Yamauchi et al. | |
| 2004/0264991 | A1 | 12/2004 | Yoshikawa | |
| 2005/0185996 | A1 * | 8/2005 | Oishi et al. | 399/329 |

FOREIGN PATENT DOCUMENTS

| | | |
|---|---|---|
| JP | 59-038777 | 3/1984 |
| JP | 06-222700 | 8/1994 |
| JP | 10-073995 | 3/1998 |
| KR | P1997-16847 | 4/1997 |
| KR | 1999-005491 | 2/1999 |
| KR | 1999-0025955 | 7/1999 |
| KR | 2000-0007678 | 5/2000 |
| KR | 1020040001806 A | 1/2004 |
| KR | 1020040043580 A | 5/2004 |

* cited by examiner

*Primary Examiner*—Quana M Grainger
(74) *Attorney, Agent, or Firm*—Roylance, Abrams, Berdo & Goodman, LLP

(57) ABSTRACT

A fuser of an electrophotographic image forming apparatus fuses a toner image to a recording medium by applying heat and pressure. The fuser includes first and second rollers that are elastically biased against each other and that rotate while facing each other. An elastic layer is provided on at least one of the first and second rollers, and a heat source is provided on at least one of the first and second rollers. A gear is coupled to an end portion of at least one of the first and second rollers. First and second interval maintenance members are respectively coupled to the first and second rollers at the end portions of the rollers which are opposite to the end portion where the gear is coupled. The first and second maintenance members face each other and contact each other to regulate an amount of compression of the elastic layer.

14 Claims, 9 Drawing Sheets

ROTARY ROLLER STRUCTURE EMPLOYING INTERVAL MAINTENANCE MEMBERS AND FUSER OF IMAGE FORMING APPARATUS EMPLOYING THE SAME

CROSS-REFERENCE TO RELATED PATENT APPLICATIONS

This application claims the benefit under 35 U.S.C. § 119 (a) of Korean Patent Application No. 10-2005-0056204, filed on Jun. 28, 2005, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to a rotary roller structure and a fuser of an image forming apparatus employing the rotary roller structure.

2. Description of the Related Art

A rotary roller structure transfers a sheet-shaped object, for example, a sheet of paper, with a pair of rollers that are engaged with each other and rotate. The rollers are engaged with each other at a predetermined pressure in the lengthwise direction of the rollers. The pressure should be constant during the rotation of the rollers. When any of the rollers has an elastic layer, the size of a nip formed by the compression of the elastic layer should be constant in the lengthwise direction during rotation of the rollers.

A rotary roller structure may be employed in a fuser of an electrophotographic image forming apparatus having a heat roller and press roller. If the pressure and nip of the heat roller and the press roller are not constant, a recording medium may be skewed. Furthermore, the heat and pressure transferred to the recording medium may become unstable so that fusing performance deteriorates. The imbalance of the pressure and nip of the two rollers is caused by various factors such as processing errors or roundness errors.

Accordingly, there is a need for an improved rotary roller structure which maintains a constant pressure and a constant nip.

SUMMARY OF THE INVENTION

An aspect of the present invention is to address at least the above problems and/or disadvantages and to provide at least the advantages described below. Accordingly, an aspect of the present invention is to provide a rotary roller structure which can stably maintain pressure and nip and a fuser of an image forming apparatus employing the rotary roller structure.

According to an aspect of the present invention, a fuser of an electrophotographic image forming apparatus for fusing a toner image to a recording medium by applying heat and pressure comprises first and second rollers. The first and second rollers have first and second end portions, respectively. The first and second rollers are elastically biased against each other and rotate while facing each other. An elastic layer is provided on at least one of the first and second rollers and a heat source is provided on at least one of the first and second rollers. A gear is coupled to the first end portion of at least one of the first and second rollers. First and second interval maintenance members are respectively coupled to the first and second rollers to face each other at the second end portions of the rollers.

The first and second interval maintenance members may be installed at both the first and second end portions of each of the first and second rollers.

According to another aspect of the present invention, a fuser of an electrophotographic image forming apparatus for fusing a toner image to a recording medium by applying heat and pressure comprises first and second rollers. The first and second rollers have first and second end portions, respectively. The first and second rollers are elastically biased against each other and rotate while facing each other. An elastic layer is formed on at least one of the first and second rollers, and a heat source heats at least one of the first and second rollers. First and second interval maintenance members are respectively coupled to the first end portions of the first and second rollers. Another set of first and second interval maintenance members are respectively coupled to the second end portions of the first and second rollers. The first and second interval maintenance members face each other.

The first interval maintenance member may be coupled to the first roller such that a portion of the first interval maintenance member having a maximum roundness error matches a portion of the first roller having a maximum roundness error.

The second interval maintenance member is coupled to the second roller such that a portion of the second interval maintenance member having a maximum roundness error matches a portion of the second roller having a maximum roundness error.

The second roller may be elastically biased toward the first roller by a pair of first elastic members.

According to another aspect of the present invention, a rotary roller structure for transferring a sheet-shaped object comprises first and second rollers elastically biased against each other. The first and second rollers have first and second end portions, respectively, and the first and second rollers rotate while facing each other. A gear is coupled to the first end portion of at least one of the first and second rollers, and first and second interval maintenance members are respectively coupled to the first and second rollers to face each other at the second end portions of the rollers.

The first and second interval maintenance members may be installed at both the first and second end portions of each of the first and second rollers.

According to another aspect of the present invention, a rotary roller structure for transferring a sheet-shaped object comprises first and second rollers elastically biased against each other. The first and second rollers have first and second end portions, respectively, and the first and second rollers rotate while facing each other. An elastic layer is formed on at least one of the first and second rollers. First and second interval maintenance members are respectively coupled to the first end portions of the first and second rollers. Another set of first and second interval maintenance members are respectively coupled to the second end portions of the first and second rollers. The first and second interval maintenance members face each other.

The first interval maintenance member may be coupled to the first roller such that a portion of the first interval maintenance member having a maximum roundness error matches a portion of the first roller having a maximum roundness error.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention. Accordingly, those of ordinary skill in the art will recognize that various changes and modifications of the exemplary embodiments described herein may be made without departing from the scope and spirit of the invention. Also, descriptions of well-known functions and constructions are omitted for clarity and conciseness.

Figure 1:
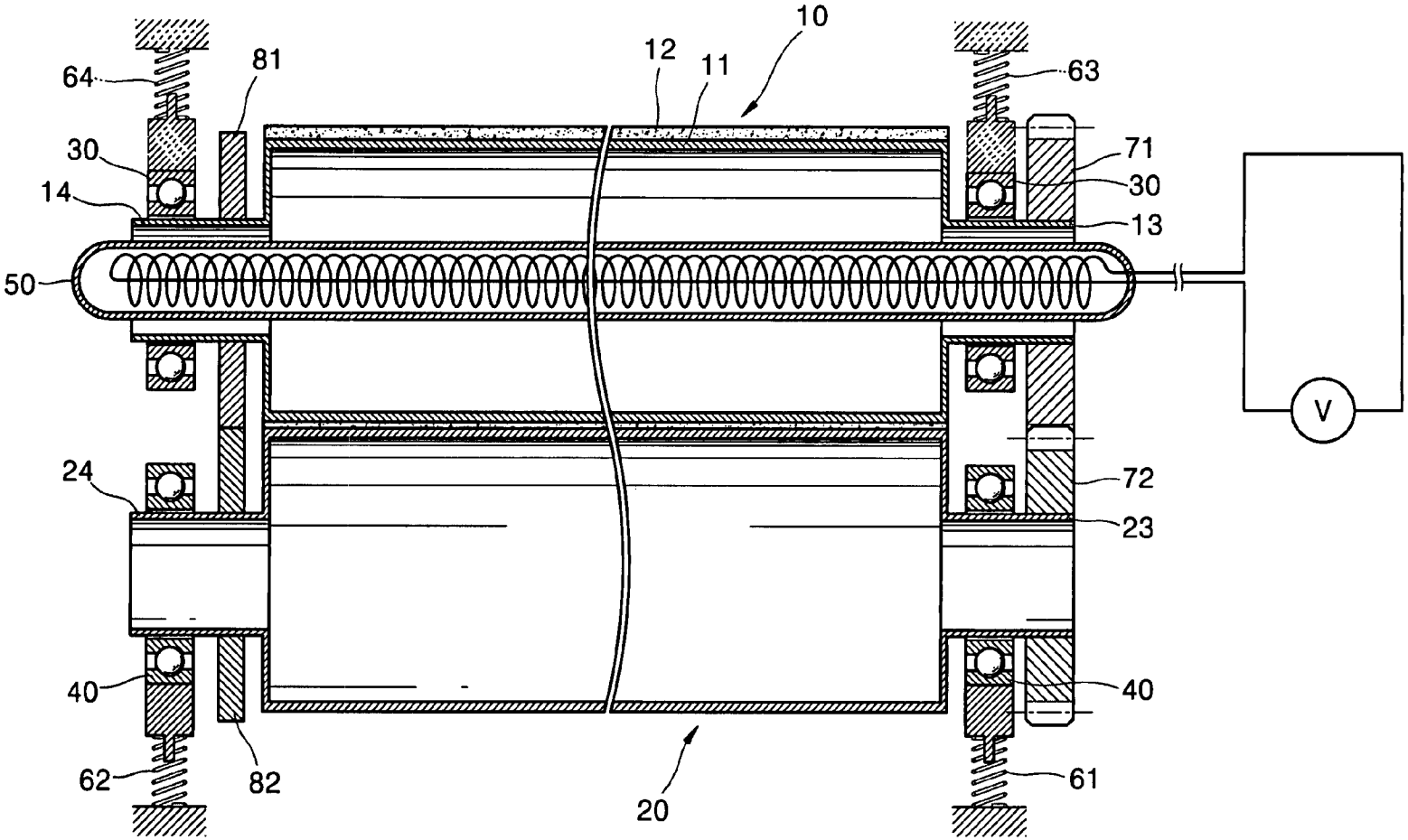
FIG. 1 is a cross-sectional view of a fuser of an image forming apparatus according to an exemplary embodiment of the present invention.

FIG. 1 shows a fuser of an image forming apparatus according to an exemplary embodiment of the present invention. An electrophotographic image forming apparatus prints an image on a recording medium by performing a series of processes of charging, exposing, developing, transferring, and fusing. In detail, the surface of a photoreceptor is charged to a uniform electric potential using a charge roller to which bias is applied or a corona charger (charging process). A light beam corresponding to image information is radiated onto the uniformly charged photoreceptor using an exposing unit such as a laser scanning unit (LSU) to form an electrostatic latent image (exposing process). Toner is supplied to the electrostatic latent image to form a toner image on the photoreceptor (developing process). The toner image is transferred to the recording medium directly or by way of an intermediary transfer unit (transferring process). Then, the toner image of an image to be printed is attached to the recording medium by an electric force. When heat and pressure are applied to the recording medium using a fuser, the toner is melted and permanently attached to the recording medium (fusing process).

Figure 2:
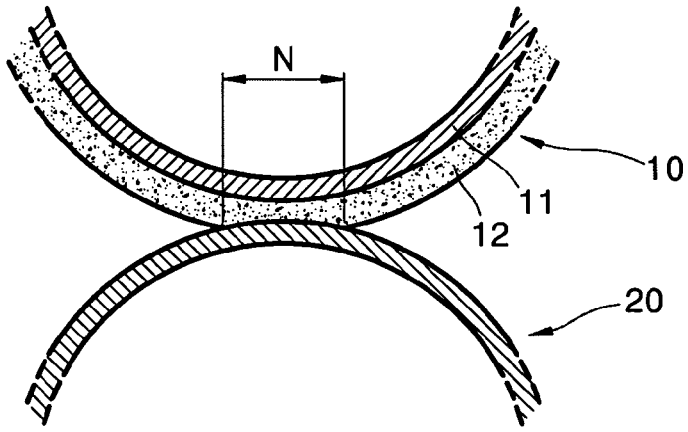
FIG. 2 is a cross-sectional view of a nip according to an exemplary embodiment of the present invention.

Referring to FIG. 1, the fuser includes a heat roller (first roller) 10 and a press roller (second roller) 20. The heat roller 10 includes a hollow pipe 11 and an elastic layer 12 formed of, for example, silicon rubber and coated on the surface of the hollow pipe 11. The heat roller has a first end portion 13 and a second end portion 14. A heat source 50, for example, a halogen lamp, is installed in the hollow pipe 11. The press roller 20 is a metal pipe, and has a first end portion 23 and a second end portion 24. Although not shown in the drawing, it is possible that the heat roller 10 is an uncoated metal pipe and the press roller 20 is a metal pipe with an elastic layer. Alternatively, both the heat roller 10 and press roller 20 may be metal pipes with elastic layers. In the present exemplary embodiment, the heat roller 10 is rotatably supported at a fixed position by bearings 30. The press roller 20 is supported by bearings 40. A pair of first elastic members 61 and 62 press the press roller 20 against the heat roller 10. Then, as shown in FIG. 2, a nip N is formed between the heat roller 10 and the press roller 20 as the elastic layer 12 of the heat roller 10 is compressed by the press roller 20. A gear 71 is installed at the first end portion 13 of the heat roller 10 and connected to a drive motor (not shown). A gear 72 is provided at the first end portion 23 of the press roller 20 and engaged with the gear 71. When the drive motor (not shown) rotates, the heat roller 10 and the press roller 20 are rotated by the above mechanism. Alternatively, the press roller 20 may be driven by contact with the heat roller 10 so that the gear 72 does not need to be provided. Also, the gear 72 may be directly connected to the drive motor. In the present and later-described exemplary embodiments, a fuser with a heat source 50 is used as an example of a rotary roller structure for transferring a sheet-shaped object. Also, the operation and effect of the exemplary embodiments will be described with respect to a fuser. It should be understood, however, that the present invention is applicable to any rotary roller structure, and is not limited to a fuser.

As indicated by a dotted line in FIG. 1, a pair of second elastic members 63 and 64 that press the heat roller 10 against the press roller 20 may be further provided.

Figure 3:
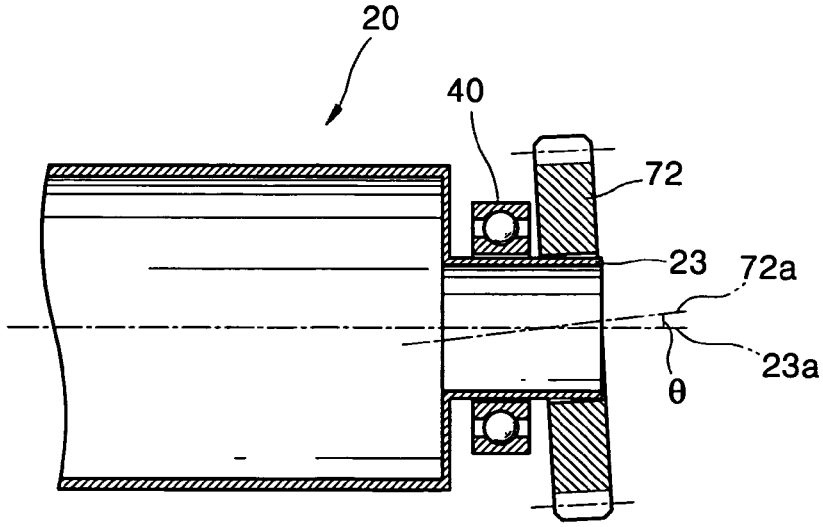
FIG. 3 is a cross-sectional view showing the inclination between a press roller and a gear.
Figure 4:
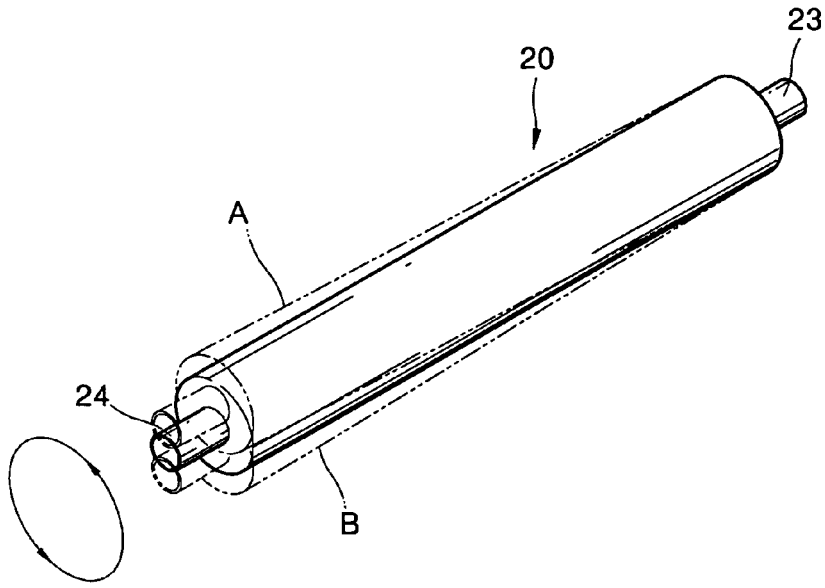
FIG. 4 is a perspective view showing the instability of the press roller.
Figure 5:
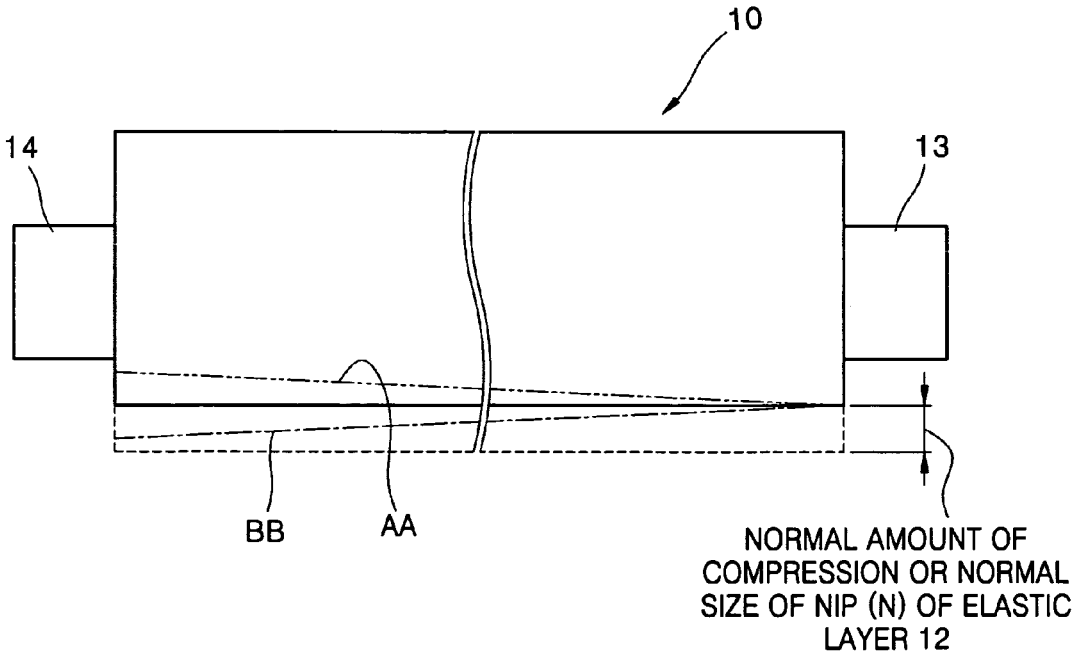
FIG. 5 is a view showing the change in the size of the nip due to the instability of the press roller.

The axes 23*a* and 72*a* of the press roller 20 and the gear 72 should be coaxial with each other. However, as shown in FIG. 3, the axes 23*a* and 72*a* of the press roller 20 and the gear 72 may be inclined at a angle θ with respect to one another due to an error in the manufacture of the gear 72 and/or an error in the processing of the end portion 23 of the press roller 20 to which the gear 72 is coupled. In this case, when the press roller 20 rotates, the second end portion 24 of the press roller 20 shakes, as shown in FIG. 4 in which the movement of the press roller 20 is exaggerated for the convenience of explanation. When the press roller 20 is located at a position "A" in FIG. 4, since the press roller 20 presses the heat roller 10, the amount of compression of the elastic layer 12 increases so that the size of the nip N increases accordingly. Thus, as indicated by a line AA in FIG. 5, the amount of compression of the elastic layer 12 and the size of the nip N increase from the end portion 13 of the heat roller 10 to the second end portion 14. When the press roller 20 is located at a position "B" in FIG. 4, the amount of compression of the elastic layer 12 and the size of the nip N decrease. Thus, as indicated by a line BB in FIG. 5, the amount of compression of the elastic layer 12 and the size of the nip N decrease from the end portion 13 of the heat roller 10 to the second end portion 14. Thus, when the heat roller 10 and the press roller 20 rotate, the as indicated by the lines AA and BB in FIG. 5, the amount of compression of the elastic layer 12 and the size of the nip N periodically repeats, increasing and decreasing.

The periodic change in the amount of compression of the elastic layer 12 and the size of the nip N may cause a sheet-shaped object, for example, a recording medium, to skew in a rotary roller structure in which the object is transferred as the first and second rollers 10 and 20 are engaged with each other. Furthermore, in a fuser employing the heat roller 10 and the press roller 20, a periodic horizontal line may be generated on the fused recording medium due to a periodic difference in the amount of heat transferred to the recording medium. Also, the lifespan of the heat roller 10 may be shortened due to accumulated fatigue of the elastic layer 12. The periodic change in the amount of compression of the elastic layer 12 and the size of the nip N may be generated by the inclination of axes (not shown) of the gear 71 and the heat roller 10 when the heat roller 10 is elastically biased by the second elastic members 63 and 64 toward the press roller 20.

To address this problem, as shown in FIG. 1, first and second interval maintenance members 81 and 82 are provided at the second end portions 14 and 24 of the heat roller 10 and the press roller 20, respectively. The first and second interval maintenance members 81 and 82 contact each other to prevent the heat roller 10 and the press roller 20 from coming to close to each other. In other words, the first and second interval maintenance members 81 and 82 contact each other at a position where the heat roller 10 and the press roller 10 form a desirable amount of compression of the elastic layer 12 and a desirable size of the nip N. Thus, the first and second interval maintenance members 81 and 82 can prevent excessive compression of the elastic layer 12 and excessive expansion of the nip N.

Furthermore, by making the elastic force of the first elastic member 62 pushing the second end portion 24 of the pressure roller 20 against the heat roller 10 larger than that of the first elastic member 61, the press roller 20 may be prevented from being separated from the heat roller 10 as indicated by the position B of FIG. 4. In this case, even when the elastic force of the first elastic member 62 is large, since the hot roller 10 and the press roller 20 are prevented from coming to close to one another by the first and second interval maintenance members 81 and 82, the amount of compression of the elastic layer 12 and the size of the nip N are maintained substantially constant.

Figure 6:
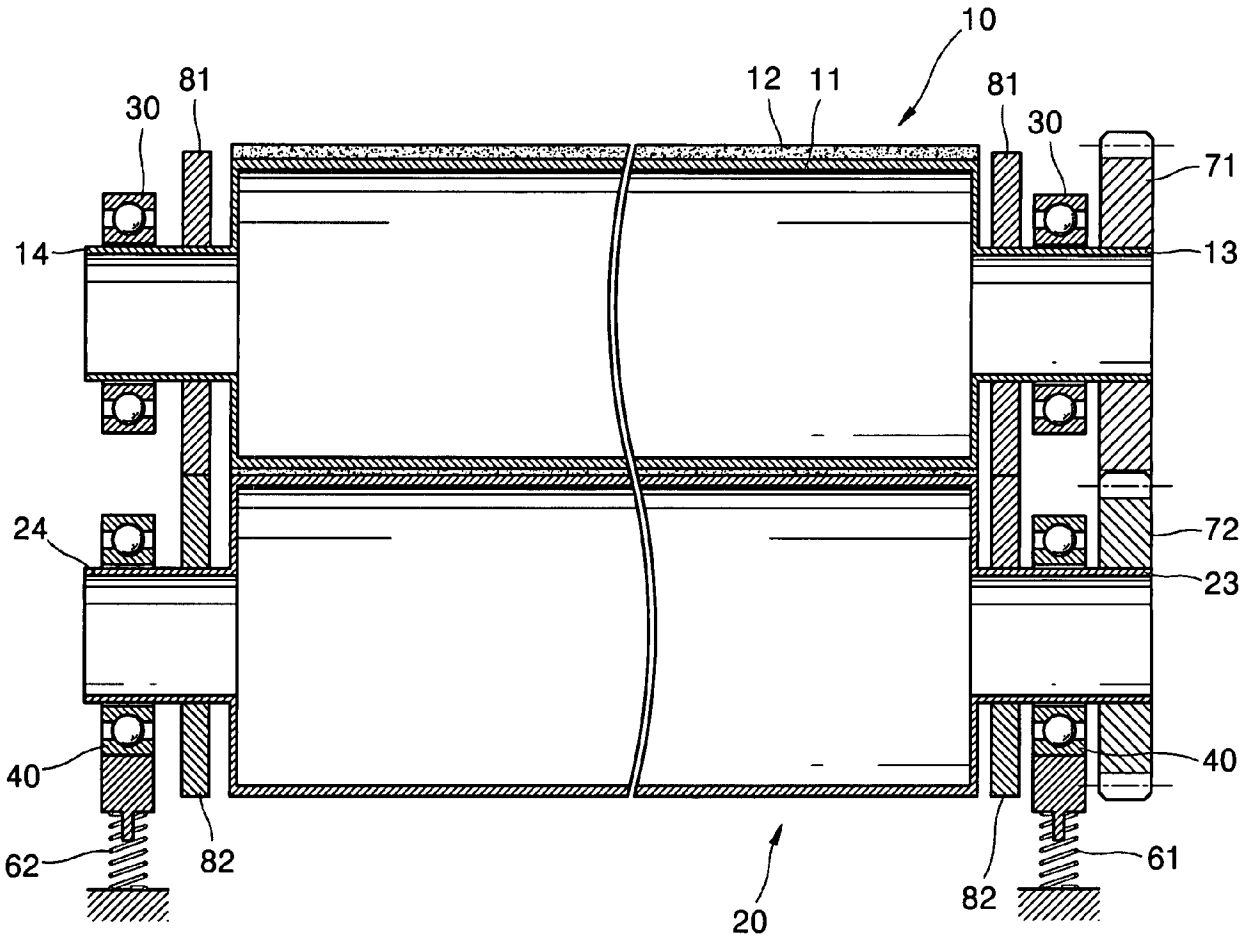
FIG. 6 is a cross-sectional view of a fuser of an image forming apparatus according to another exemplary embodiment of the present invention.

Also, as shown in FIG. 6, first and second interval maintenance members 81 and 82 may also be installed at the first end portion 13 of the heat roller 10 and the first end portion 23 of the press roller 20. By doing so, the instability of the entire press roller 20 caused by the inclination of the axis 23*a* of the press roller 20 and the axis 72*a* of the gear 72 may be prevented. In this case, even when the elastic force of the first elastic member 61 is large, since the hot roller 10 and the press roller 20 are prevented from coming to close to one another by the first and second interval maintenance members 81 and 82, the amount of compression of the elastic layer 12 and the size of the nip N are maintained substantially constant.

The above-described configuration may prevent a transferred object (such as a recording medium) from skewing, and may prevent the generation of a horizontal line on the fused recording medium. Also, this configuration may improve the reliability of the rotary roller structure and a fuser that employs the same.

As shown in FIG. 6, the heat roller 10 is rotatably supported by the bearing 30 at a fixed position and, while being supported by the bearing 40, the press roller 20 is pressed by the first elastic members 61 and 62 against the heat roller 10. When the press roller 20 contacts the elastic layer 12 of the heat roller 10, the elastic layer 12 is compressed and generates a repulsive force. Physical properties such as elastic coefficients of the first elastic members 61 and 62 are determined so that a desirable amount of compression of the elastic layer 12 and a desirable size of the nip N are obtained when the repulsive force and the elastic force of the first elastic members 61 and 62 are balanced. When the elastic forces of the first elastic members 61 and 62 are excessively large, the elastic layer 12 of the heat roller 10 is compressed too much and the nip N increases too much, which may have a significant influence on the lifespan of the heat roller 10.

In contrast, when the elastic forces of the first elastic members 61 and 62 are too small, the nip N is decreased too much so that the recording medium is not properly transferred or the heat needed for fusing is not properly transferred to the recording medium. Thus, the elastic forces of the first elastic members 61 and 62 are designed to maintain the desirable amount of compression of the elastic layer 12 and the desirable size of the nip N. However, despite the above design, the amount of the elastic forces of the first elastic members 61 and 62 may be different from each other due to assembly or manufacturing errors. For example, the elastic force of the first elastic member 61 may be greater than that of the first elastic member 62. In this case, the elastic layer 12 at the end portion 13 of the heat roller 10 is compressed more so that the nip N increases. Also, when the thickness of the elastic layer 12 of the heat roller 10 is inconsistent due to a manufacturing error of the heat roller 10, for example, when the elastic layer 12 at the end portion 13 of the heat roller 10 is thick while the elastic layer 12 at the second end portion 14 is thin, the first elastic member 61 is compressed more, and a larger elastic force is applied to the press roller 20. Thus, the elastic layer 12 at the end portion 13 of the heat roller 10 is more compressed and the nip N is increased.

Figure 7:
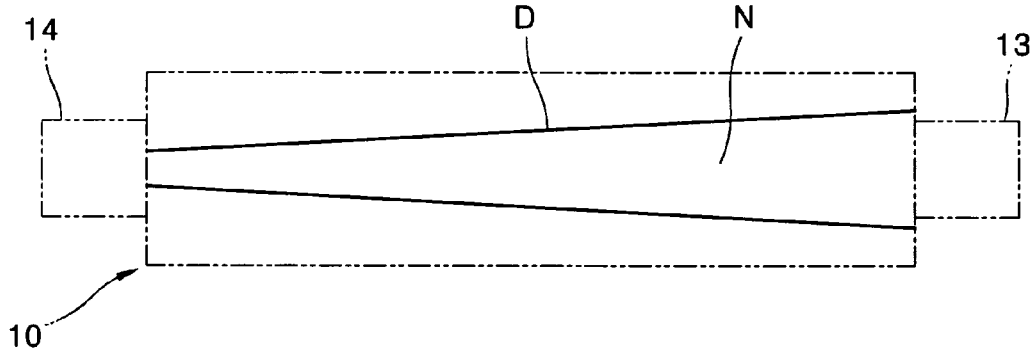
FIG. 7 is a view showing the change in the size of the nip due to the imbalance in the elastic force of a pair of first elastic members and the irregularity in the thickness of an elastic layer.

FIG. 7 shows the variation of the nip N caused by the imbalance in the elastic forces of the first elastic members 61 and 62 or the irregularity in the thickness of the elastic layer 12 of the heat roller 10. Referring to FIG. 7, the nip N decreases from the end portion 13 of the heat roller 10 to which a large elastic force is applied to the second end portion 14 so that a boundary D of the nip N is inclined. This can cause problems such as a deterioration of the quality of a fused image and skewing of the recording medium. To address these problems, as shown in FIG. 6, the first and second interval maintenance members 81 and 82 are installed at both end portions 13 and 14 of the heat roller 10 and both end portions 23 and 24 of the press roller 20. The first and second interval maintenance members 81 and 82 make the interval between the heat roller 10 and the press roller 20 uniform despite an imbalance in the elastic forces of the first elastic members 61 and 62 or an irregularity in the thickness of the elastic layer 12 of the heat roller 10. Thus, the amount of compression of the elastic layer 12 and the size of the nip N remain constant despite an imbalance in the elastic force of the first elastic members 61 and 62 or an irregularity in the thickness of the elastic layer 12 of the heat roller 10. According to the above configuration, the irregularity in the nip N or the inclination of the boundary of the nip N may be prevented, as shown in FIG. 7.

Moreover, the outer circumferential surface of the heat roller 10, that is, the surface of the elastic layer 12, may not be a perfect circle. The heat roller 10 is typically manufactured by coating the elastic layer 12 on the hollow pipe 11, and the hollow pipe 11 is typically manufactured by extruding a metal material such as aluminum. A roundness error of the outer circumferential surface may be generated during the process of extruding the metal material and/or coating the elastic layer 12. Of course, the press roller 20 may also have a roundness error. For example, referring to FIG. 8, the heat roller 10 indicated by a solid line represents a heat roller with roundness errors. The heat roller 10 indicated by a dotted line represent an ideal heat roller (that is, one without roundness errors). When these two rollers are compared, the maximum positive roundness error (+δmax) and the maximum negative roundness error (−δmax) occur at around angles of 90° and 270°, respectively. FIG. 9 shows the changes in the amount of compression of the elastic layer 12 and the size of the nip N when the heat roller 10 is applied to the fuser shown in FIG. 6. In FIG. 9, it is assumed that the press roller 20 is a perfect circle and there is no irregularity in the thickness of the elastic layer 12 in the lengthwise direction of the heat roller 10. Referring to FIG. 9, if the heat roller 10 is an ideal perfect circle, the size of the nip N remains unchanged as indicated by a dotted line although the heat roller 10 rotates once. When the heat roller 10 having roundness errors (+δmax and −δmax) rotates, however, the amount of compression of the elastic layer 12 and the size of the nip N have desirable values at angles of around 0° and 180°. When the roundness error becomes a positive value, the press roller 20 is pushed and the first elastic members 61 and 62 are compressed so that a large elastic force is applied to the press roller 20. The elastic layer 12 is compressed by the elastic force. The press roller 20 is stopped at a position where the elastic force and the repulsive force by the compression of the elastic layer 12 are balanced. At this time, the size of the nip N is larger than that of the desirable nip N. The size of the nip N at the position of 90° where the roundness error is the maximum positive value (+δmax) becomes larger than the desirable size. The size of the nip N is at a minimum at the position of 270° where the roundness error is the maximum negative value (−δmax).

Since the nip N increases at the position where the roundness error is the maximum positive value (+δmax), a larger amount of heat and pressure are transferred to the toner image on the recording medium. Conversely, a lesser amount of heat and pressure are transferred to the toner image at the position where the roundness error is the minimum negative value (−δmax). This irregular transfer of heat and pressure may produce a noticeable stain such as a wave pattern after fusing is completed. Also, the rotary roller structure transfers the object in an irregular manner due to the roundness errors.

Furthermore, when the rotational speed of the heat roller 10 having a roundness error increases, the elastic forces of the first elastic members 61 and 62 and the repulsive force by the compression of the elastic layer 12 are not balanced. Thus, the press roller 20 repeatedly approaches and separates from the heat roller 10, causing instability. The instability of the press roller 20 may be prevented to a degree by increasing the elastic force of the first elastic members 61 and 62. In this case, however, since the size of the nip N excessively increases at the position where the roundness error is at a maximum (+δmax), the lifespan of the heat roller 10 may be adversely affected.

Figure 10:
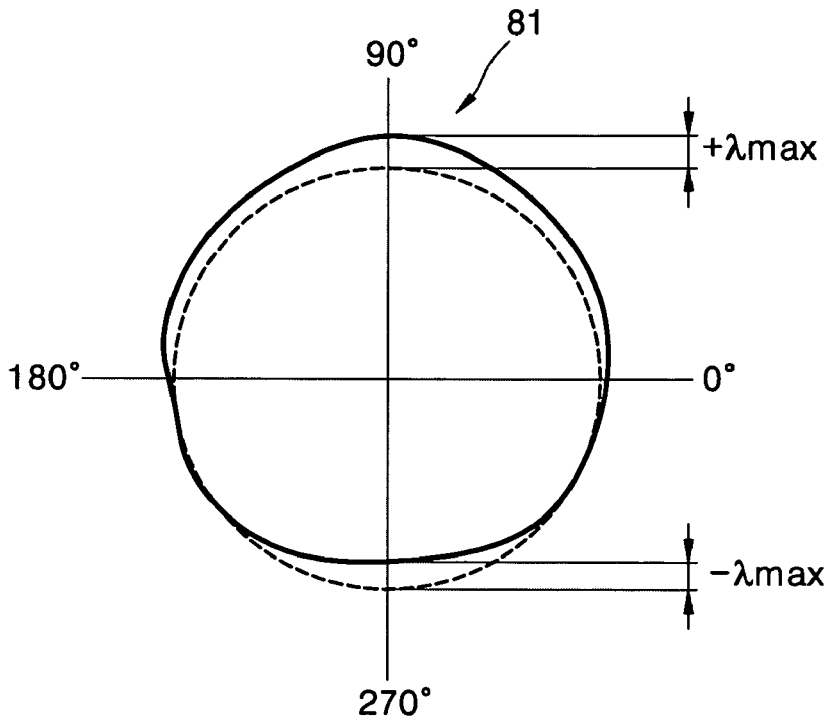
FIG. 10 is a view showing an error in the roundness of a first interval maintenance member.
Figure 11:
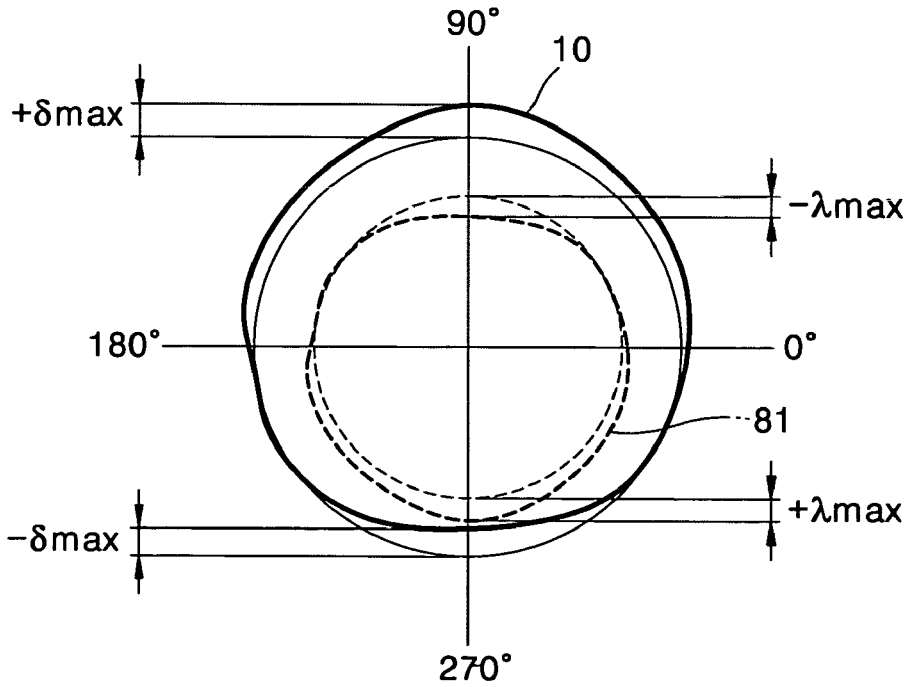
FIG. 11 is a view showing an example of an undesirable combination of the heat roller and a first interval maintenance member.
Figure 12:
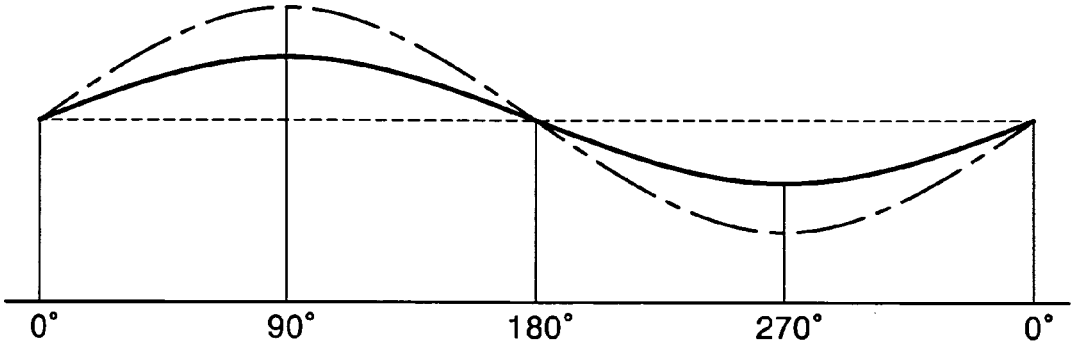
FIG. 12 is a view showing the change in the size of a nip in the undesirable combination of the heat roller and first interval maintenance member shown in FIG. 11.

The instability of the press roller 20 may be further impacted by roundness errors of the first interval maintenance member 81. Referring to FIG. 10, the first interval maintenance member 81 may have a roundness error. For example, it is assumed that the roundness error of the first interval maintenance member 81 are the maximum positive value (+λmax) and the minimum negative value (−λmin) at angles of around 90° and 270°, respectively. When the heat roller 10 and the first interval maintenance member 81 are coupled to each other, as shown in FIG. 11, it may be assumed that +δmax and −λmax are matched and −δmax and +λmax are matched. In FIG. 12, the dotted line indicates the size of the nip N when the heat roller 10 is an ideal perfect circle, the solid line indicates that the heat roller 10 has roundness errors of ±δmax, and the one-dot chain line indicates the size of the nip N when the heat roller 10 and the first interval maintenance member 81 are coupled to each other by matching +δmax and −λmax, and −δmax and +λmax. It may be seen that the change in the size of the nip N is significant in the one-dot chain line. This is because the amount of compression of the elastic layer 12 further increases as the press roller 20 further moves toward the heat roller 10 by the elastic forces of the first elastic members 61 and 62 since the first interval maintenance member 81 has −λmax at a position where the heat roller 10 has +δmax. Also, since the first interval maintenance member 81 has +λmax at a position where the heat roller 10 has −δmax, the press roller 20 is separated from the heat roller 10 so that the amount of compression of the elastic layer 12 is further decreased.

Figure 13:
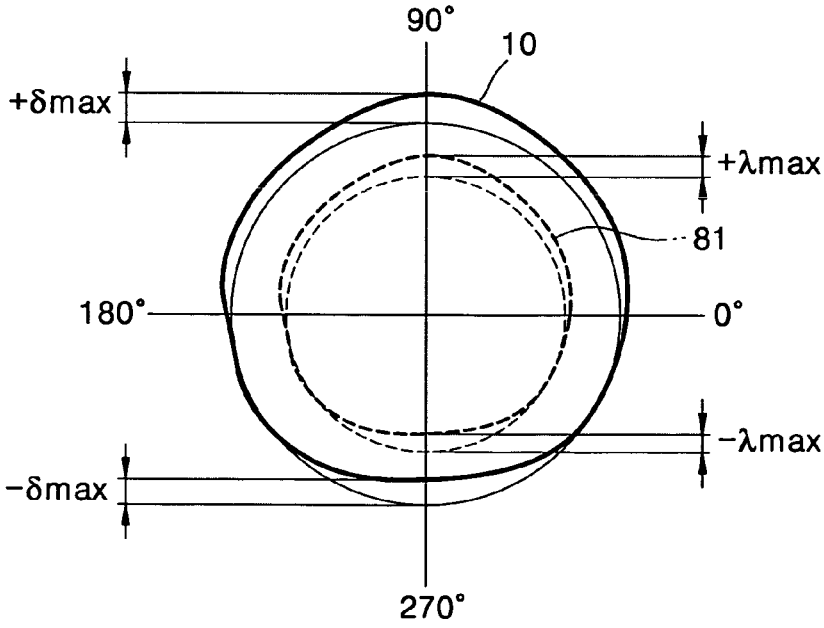
FIG. 13 is a view showing an example of a desirable combination of the heat roller and the first interval maintenance member according to an exemplary embodiment of the present invention.
Figure 14:
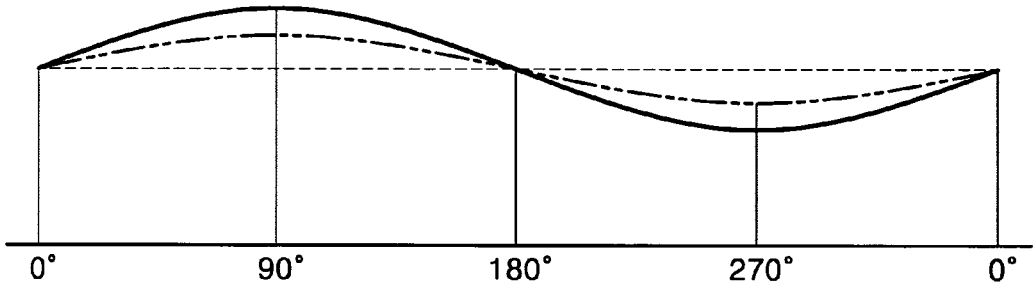
FIG. 14 is a view showing the change in the size of a nip in the desirable combination of the heat roller and first interval maintenance member shown in FIG. 13.

To address the above problem, as shown in FIG. 13, +δmax and +λmax are matched when the heat roller 10 and the first interval maintenance member 81 are coupled to each other. In FIG. 14, a dotted line indicates the size of the nip N when the heat roller 10 is an ideal perfect circle, a solid line indicates the size of the nip N when the heat roller 10 has roundness errors of ±δmax and the first interval maintenance member 81 is an ideal perfect circle, and a double-dot chain line indicates the size of the nip N when the heat roller 10 and the first interval maintenance member 81 are coupled to each other by matching +δmax and +λmax, and −δmax and −λmax. As shown in FIG. 14, since the press roller 20 is separated from the heat roller 10 as the first and second interval maintenance members 81 and 82 contact each other at a position (at an angle of about 90°) where the roundness error of the heat roller 10 is +δmax, the increase of the size of the nip N may be alleviated. Also, when −δmax and −λmax are matched, since the press roller 20 approaches the heat roller 10 as the first and second interval maintenance members 81 and 82 contact each other at a position (at an angle of about 270°) where the roundness error of the heat roller 10 is −δmax, the decrease of the size of the nip N may be alleviated.

Figure 8:
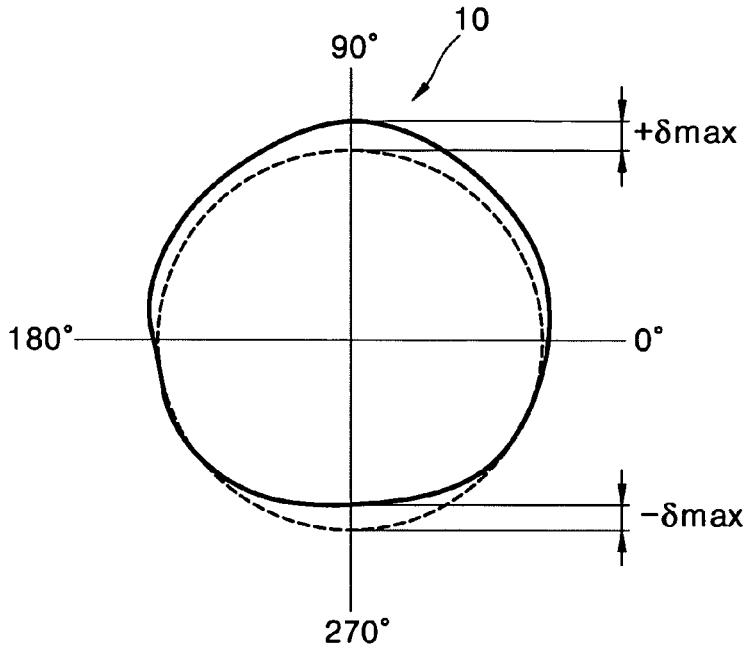
FIG. 8 is a view showing an error in the roundness of a heat roller.
Figure 9:
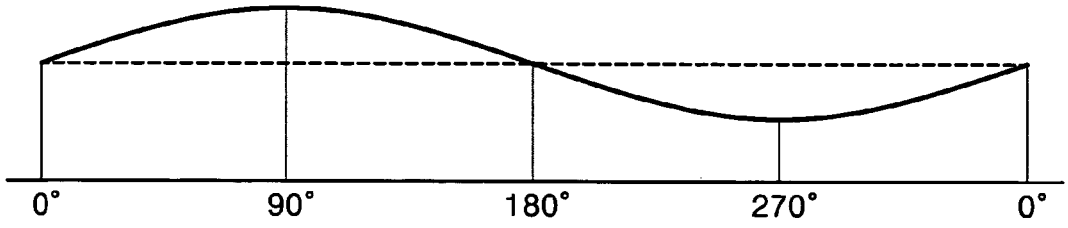
FIG. 9 is a view showing the change in the size of the nip due to the error in the roundness of the heat roller.

Although the roundness errors of the heat roller 10 and the first interval maintenance member 81 may not be the same as those shown in FIGS. 8 and 10, the roundness error of the heat roller 10 and the first interval maintenance member 81 typically becomes uniform in a mass production process. Thus, the position (positive "+δmax" or negative "−δmax") where the roundness error of the heat roller 10 becomes maximum may be marked. Also, the position (positive "+λmax" or negative "−λmax") where the roundness error of the first interval maintenance member 81 becomes maximum may be marked. The instability of the press roller 20 due to the roundness error of the heat roller 10 may be alleviated to a degree by coupling the first interval maintenance member 81 to the heat roller 10 with these marking positions matched. The instability of the press roller 20 may be remarkably alleviated compared to a case in which the heat roller 10 and the first interval maintenance member 81 are coupled to each other without considering the roundness errors.

Although not shown in the drawings, the press roller 20 and the second interval maintenance member 82 may have roundness errors. When the press roller 20 and the second interval maintenance member 82 are coupled to each other, by matching the positions where the roundness errors thereof are at the maximum values, the instability of the press roller 20 may be alleviated.

As described above, according to the exemplary embodiment of a rotary roller structure according to the present invention, since the nip between two rollers remains substantially uniform, an object may be stably transferred without skew. Also, according to the exemplary embodiment of a fuser according to the present invention, a recording medium may be stably transferred without skew. Heat and pressure may be uniformly applied to a toner image formed on the recording medium so that the quality of a fused image may be improved.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A fuser of an electrophotographic image forming apparatus for fusing a toner image to a recording medium by applying heat and pressure, the fuser comprising:

a first roller having a first end portion and a second end portion;

a second roller having a first end portion and a second end portion, the first and second rollers being elastically biased against each other and rotating while contacting each other;

an elastic layer provided on at least one of the first and second rollers;

a heat source provided on at least one of the first and second rollers;

a gear coupled to a first end portion of at least one of the first and second rollers; and first and second interval maintenance members respectively coupled to the second end portions of the first and second rollers, the first and second interval maintenance members facing each other, the first and second interval maintenance members contacting each other to prevent excessive compression of the elastic layer;

wherein the first interval maintenance member is coupled to the first roller such that a portion of the first interval maintenance member having a maximum roundness error matches a portion of the first roller having a maximum roundness error.

2. The fuser as claimed in claim 1, further comprising:

additional first and second interval maintenance members installed at the first end portions of the first and second rollers.

3. The fuser as claimed in claim 1, wherein the second interval maintenance member is coupled to the second roller such that a portion of the second interval maintenance member having a maximum roundness error matches a portion of the second roller having a maximum roundness error.

4. The fuser as claimed in claim 1, wherein the second roller is elastically biased toward the first roller by a pair of first elastic members.

5. A fuser of an electrophotographic image forming apparatus for fusing a toner image to a recording medium by applying heat and pressure, the fuser comprising:

a first roller having a first end portion and a second end portion;

a second roller having a first end portion and a second end portion, the first and second rollers being elastically biased against each other and rotating while contacting each other;

an elastic layer provided on at least one of the first and second rollers;

a heat source provided on at least one of the first and second rollers;

first and second interval maintenance members respectively coupled to the first end portions of the first and second rollers; and additional first and second interval maintenance members respectively coupled to the second end portions of the first and second rollers;

wherein the first and second interval maintenance members contact each other to prevent excessive compression of the elastic layer; and wherein the first interval maintenance member is coupled to the first roller such that a portion of the first interval maintenance member having a maximum roundness error matches a portion of the first roller having a maximum roundness error.

6. The fuser as claimed in claim 5, wherein the second interval maintenance member is coupled to the second roller such that a portion of the second interval maintenance member having a maximum roundness error matches a portion of the second roller having a maximum roundness error.

7. The fuser as claimed in claim 5, wherein the second roller is elastically biased toward the first roller by a pair of first elastic members.

8. A rotary roller structure for transferring a sheet shaped object, comprising:

a first roller having a first end portion and a second end portion;

a second roller having a first end portion and a second end portion, the first and second rollers being elastically biased against each other and rotating while facing each other;

a gear coupled to an end portion of at least one of the first and second rollers; and first and second interval maintenance members respectively coupled to the first and second rollers to face each other at the side of the second end portion of the roller where the gear is coupled;

wherein the first interval maintenance member is coupled to the first roller such that a portion of the first interval maintenance member having a maximum roundness error matches a portion of the first roller having a maximum roundness error.

9. The rotary roller structure as claimed in claim 8, further comprising:

first and second interval maintenance members installed at the first end portions of the first and second rollers.

10. The rotary roller structure as claimed in claim 8, wherein the second interval maintenance member is coupled to the second roller such that a portion of the second interval maintenance member having a maximum roundness error matches a portion of the second roller having a maximum roundness error.

11. The rotary roller structure as claimed in claim 8, wherein the second roller is elastically biased toward the first roller by a pair of first elastic members.

12. A rotary roller structure for transferring a sheet-shaped object, comprising:

a first roller having a first end portion and a second end portion;

a second roller having a first end portion and a second end portion, the first and second rollers being elastically biased against each other and rotating while contacting each other;

an elastic layer provided on at least one of the first and second rollers;

first and second interval maintenance members respectively coupled to the first end portions of the first and second rollers; and additional first and second interval maintenance members respectively coupled to the second end portions of the first and second rollers;

wherein the first and second interval maintenance members contact each other to prevent excessive compression of the elastic layer; and wherein the first interval maintenance member is coupled to the first roller such that a portion of the first interval maintenance member having a maximum roundness error matches a portion of the first roller having a maximum roundness error.

13. The rotary roller structure as claimed in claim 12, wherein the second interval maintenance member is coupled to the second roller such that a portion of the second interval maintenance member having a maximum roundness error matches a portion of the second roller having a maximum roundness error.

14. The rotary roller structure as claimed in claim 12, wherein the second roller is elastically biased toward the first roller by a pair of first elastic members.

* * * * *